United States Patent [19]

Dalzell et al.

[11] 4,307,182

[45] Dec. 22, 1981

[54] IMAGING SYSTEMS WITH TETRA(ALIPHATIC) BORATE SALTS

[75] Inventors: Rex J. Dalzell, Somerset, Wis.; Edward J. Goettert, Lake Elmo; George V. D. Tiers, St. Paul, both of Minn.

[73] Assignee: Minnesota Mining and Manufacturing Company, St. Paul, Minn.

[21] Appl. No.: 152,601

[22] Filed: May 23, 1980

[51] Int. Cl.[3] ..... G03C 1/00; G03C 1/72

[52] U.S. Cl. ..... 430/339; 430/495; 430/914; 430/340; 430/338; 430/270

[58] Field of Search ..... 568/1; 428/427, 913; 106/18.3; 430/495, 541, 270, 339, 338, 340, 914; 564/8, 296

[56] References Cited

U.S. PATENT DOCUMENTS

| | | | |
|---|---|---|---|
| 3,567,453 | 3/1971 | Borden | 430/339 |
| 3,716,366 | 2/1973 | Riester | 430/338 |
| 3,754,921 | 8/1973 | Riester | 430/338 |

FOREIGN PATENT DOCUMENTS

| | | | |
|---|---|---|---|
| 1370058 | 10/1974 | United Kingdom | 430/339 |
| 1370059 | 10/1974 | United Kingdom | 430/339 |
| 1370060 | 10/1974 | United Kingdom | 430/339 |
| 1386269 | 3/1975 | United Kingdom | 430/339 |

OTHER PUBLICATIONS

Chemical Abstracts, vol. 66, 1967, 37986q.

Kazitsyna et al., "Synthesis, Structure, and Infrared Spectra of Aryldiazonium Halogenoborates and Tetraphenylborates", Izvestiya Akademii Nauk SSSR, No. 3, pp. 448–453, Mar. 1962.

*Primary Examiner*—Won H. Louie, Jr.

*Attorney, Agent, or Firm*—Cruzan Alexander; Donald M. Sell; Mark A. Litman

[57] ABSTRACT

A radiation sensitive element comprising a substrate having coated on at least one side thereof a layer comprising a radiation sensitive tetra(aliphatic) borate salt.

16 Claims, No Drawings

IMAGING SYSTEMS WITH TETRA(ALIPHATIC) BORATE SALTS

FIELD OF THE INVENTION

This invention relates to imaging processes and in particular to dye bleaching image forming systems. A light sensitive system comprising a dye and a tetra(aliphatic)borate is shown to have improved properties over known aromatic borate light-sensitive systems.

BACKGROUND OF THE INVENTION

There exists a vast array of imaging systems having a multitude of various constructions and compositions. Amongst the more widely used systems are silver halide light sensitive systems (including black and white and color photography, dry silver photothermography, instant photography, and diffusion transfer systems, amongst others), photopolymeric systems (including planographic and relief printing plates, photoresist etching systems, and imaging transfer systems), diazonium color coupling systems, and others. Each system has its own properties attributable to the phenomenon which forms the basis of the imaging technology. For example, silver halide imaging systems are noted both for amplication (i.e., image densities which can be increased by further development without additional imagewise exposure) due to the catalytic action of silver towards the reduction of silver ion and for the fact that light sensitivity may be stopped after development by washing away the light sensitive silver halide salt (i.e., fixing). Photopolymeric systems are noted for image stability and ease of application of the imaging layer. Diazonium color coupling systems have high image resolution and are easy to coat onto supporting substrates.

One other type of imaging system which has received some attention in recent years uses a salt comprising an aromatic tetra(hydrocarbyl)borate anion as a dye-bleaching or solubility-altering photosensitive compound. U.S. Pat. No. 3,567,453 discloses the use of such borate salts (having at least one aryl substituent on the borate) in photoresist and lithographic compositions. U.S. Pat. No. 3,754,921 discloses an imaging system comprising a leucophthalocyanine and "phenylboronate." U.S. Pat. No. 3,716,366 even indicates that image stabilization might be achieved by reaction or dissolution and removal of one of the components (column 5, lines 1–8). British Pat. Nos. 1,370,058; 1,370,059; 1,370,060; and 1,386,269 also disclose dye bleaching processes using aromatic borates as light sensitive agents.

U.S. Pat. No. 3,716,366 suggests that desensitization may be effected by reactions with one of the components to form stable colorless products, and specifically suggests selectively dissolving out one of the components. No specific reagents or reaction mechanisms are suggested for the desensitization process, however.

SUMMARY OF THE INVENTION

It has been found that light sensitive systems can be formed with tetra(aliphatic)borates. It is believed that substantially all light sensitive systems and particularly dye bleaching systems which previously used aromatic borates can use tetra(aliphatic)borates and generally produce faster acting systems.

Light sensitive systems using aromatic tetra(hydrocarbyl)borates are known to comprise such various constructions as (1) substrates having the borate coated directly on the surface of the substrate or in a binder (e.g., U.S. Pat. No. 3,567,453), (2) binders containing the borate and leuco forms of dyes (e.g., U.S. Pat. No. 3,754,921), (3) binders containing the borate and bleachable dyes (e.g., British Pat. Nos. 1,386,269; 1,370,058; 1,370,059; and 1,370,060), and (4) combinations of colorable organic salts and borates, with or without binders (e.g., U.S. Pat. No. 3,716,366).

These light sensitive systems may also be rendered light insensitive, particularly after imaging has been effected, by converting the borate to a product which does not have four carbon-to-boron bonds.

DETAILED DESCRIPTION OF THE INVENTION

Borates are variously referred to in the art as borates, boronates, boronides and other chemical terms. In the practice of the present invention, borates are strictly defined as tetra(hydrocarbyl)borates; that is, a compound having four carbon-to-boron bonds. The compounds used in the present invention are tetra(aliphatic)borates, wherein all of the carbon-to-boron bonds are from aliphatic groups. These compounds may be represented by the formula:

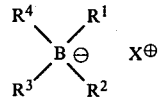

wherein $R^1$, $R^2$, $R^3$, and $R^4$ are independently aliphatic groups bonded to the boron from a carbon atom, and $X^+$ is any cation except boron to carbon bond cleaving cations, e.g., $H^+$. The groups $R^1$, $R^2$, $R^3$, and $R^4$ may be independently selected from alkyl, alkaryl, alkenyl, alkynyl, allyl, cyano, and alkyl-heterocyclic groups. Preferably there is no more than one cyano group or no cyano groups bonded to the boron. It is generally preferred that alkyl and allyl groups be bonded to the boron. When the substituents are referred to in the practice of this invention as groups, i.e., alkyl groups versus alkyl, that nomenclature specifically is defined as allowing for substitution (other than by groups which generate $H^+$ or other fixing groups) on the alkyl moiety (e.g., ether or thioether linkages within the alkyl, halogen, cyano, acyloxy, acyl or hydroxy substitution, etc.), always providing that the alkyl group must be bonded to the boron from a carbon atom. Thus, alkoxy and phenoxy would not be included. Alicyclic groups are also included within the term aliphatic. Preferably no group contains more than twenty carbon atoms. More preferably they contain no more than twelve carbon atoms, and most preferably no more than eight carbon atoms. Substituents which render the groups $R^1$, $R^2$, $R^3$, and $R^4$ less electronegative are preferred.

Any cation except cations which break at least one carbon to boron bond on the borate, e.g., $H^+$. As a standard test, one could limit the cations to those which do not break at least one carbon to boron bond of tetraphenyl borate. This can be readily determined by standard analytical gas chromatography, infrared or mass spectrometry, nuclear magnetic resonance, may be used. Preferably they are not readily reducible metal cations such as $Ag^+$, $Pd^{++}$ and $Fe^{+++}$. Generally, metal ions less readily reducible than ferric ion are not desired. The nature of the cation has not been found to be otherwise critical in the practice of the present invention. The most significant contribution of the cation may be its effects upon solubility in different solvents or binders. The cations may include, for example, organic cations, simple elemental cations such as alkali metal cations (e.g., $Li^+$, $Na^+$, and $K^+$) and quaternary ammonium cations, e.g., such as represented by formula:

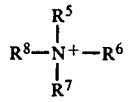

wherein $R^5$, $R^6$, $R^7$, and $R^8$ are independently selected from aliphatic (e.g., alkyl and particularly alkyl of 1 to 12 or preferably 1 to 4 carbon atoms), aryl (e.g., phenyl and naphthyl groups), and alkaryl (e.g., benzyl groups) groups. For example, tetramethyl, tetraethyl, tetrapropyl, tetrabutyl and triethylmonomethyl ammonium are particularly useful. Cations such as N-alkylpyridinium, phenyltrimethylammonium and benzyltriethylammonium are also quite satisfactory as are phosphoniums and sulfoniums. Quaternary cations in more complex forms such as quaternary dyes and quaternized groups in polymer chains are also particularly useful. The polymers, for example could contain repeating groups such as:

a.

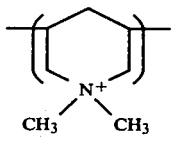

b.

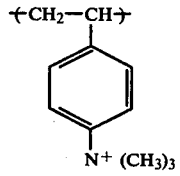

c.

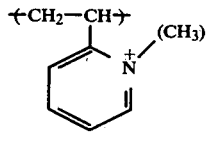

d.

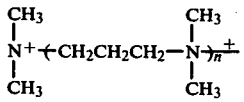

and e.

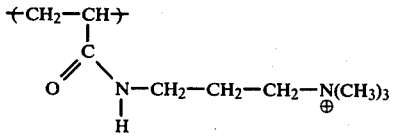

With the proper selection of quaternary ammonium cations, such polymeric materials could also serve as a binder for the system.

The dyes, for example, may be of any color and any chemical class. The dyes, of course, should not contain groups which would fix or desensitize the borate salts (e.g., carboxylic acid groups, sulfonic acid groups, and readily reducible metal cations such as metal cations at least as readily reducible as ferric ion). The following are examples of dyes used in the practice of the present invention:

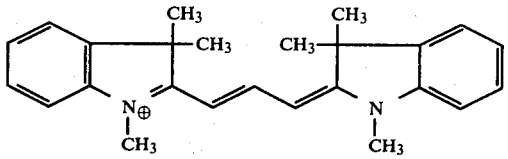

(magenta dye cation, Indolenine Red)

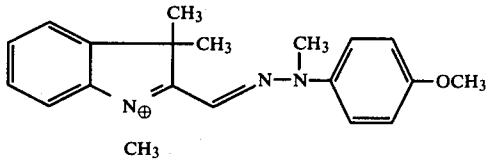

(yellow dye cation)

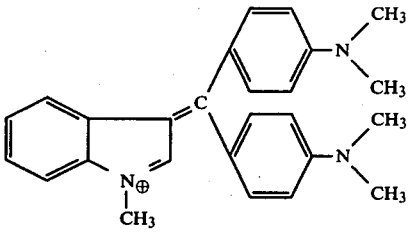

(cyan dye cation)

when cationic dyes have been used, a slight excess of a salt providing the borate anion is desired to provide complete bleaching.

Other cationic dyes are useful, and the dyes may have anions other than borates, such as the ionic dyes of the formula:

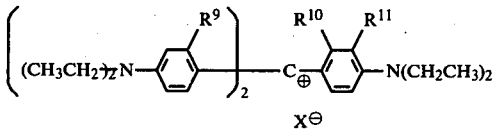

wherein $X^-$ is any anion including $Cl^-$, $I^-$, $Br^-$, perfluoro(4-ethylcyclohexane)sulfonate, sulfate, methyl sulfate, methanesulfonate, etc.

$R^9$ and $R^{10}$ are independently H, alkyl or alkoxy (preferably 1 to 12 carbon atoms and most preferably 1 to 4 carbon atoms), Cl, Br, and I, $R^{11}$ is H or alkyl, preferably 1 to 12 and most preferably 1 to 4 carbon atoms. Virtually any neutral or cationic dye is useful in the practice of the present invention, and their listing is merely cumulative.

Imaging in the light sensitive systems comprising tetra(aliphatic)borate, dye and binder is affected by irradiation. The radiation which is absorbed by the dye-borate system causes the dye to bleach. A positive image is thus produced. The use of cationic dyes is believed to spectrally sensitize the borates to radiation absorbed by the dyes associated with the borate. These are not used as sensitizing dyes as used in photographic imaging systems (usually in ratios of 1/500 or 1/10,000 of dye to light sensitive agents). These dyes are used in proportions of at least 1/10 to about 1/1 in ratio to the borate. Because the dye-borate system is molecularly spectrally sensitive, a multiplicity of colored dyes may be used (e.g., cyan, magenta, and yellow) in the same or different layers.

Binders, when used in the present invention, should be transparent or at least translucent. According to some practices of the present invention, the layers need not be penetrable by solvents or gases. Binders such as natural resins (e.g., gelatin, gum arabic, etc.), synthetic resins (e.g., polyacrylates, polymethacrylates, polyvinyl acetals, cellulose esters, polyamides, polycarbonates, polyolefins, polyurethanes, polyepoxides, polyoxyalkylenes, styrene/acrylonitrile copolymers, polyvinylhalides, polysiloxanes, polyvinylacetate, polyvinyl alcohol, etc.), and other media may be used. The binders may be thermoplastic or highly crosslinked.

The desensitization or fixing of the light sensitive tetra(hydrocarbyl)borates is effected by disrupting at least one of the carbon-to-boron bonds on the compound. The compound may still have four bonds to the boron, but if at least one is no longer a carbon-to-boron bond, the resulting dye-borate system will not be light sensitive and the image will be stable. The conversion of the borates having four carbon-to-boron bonds can be effected in a variety of fashions. Introducing an acid to reactive association with the tetra(hydrocarbyl)borate will effect such a conversion. This has been done for example, by subjecting the sheet to hydrochloric acid vapor, coating the sheet lightly with acetic acid, placing an acid containing polymeric sheet in temporary or permanent association with the imaging sheet and heating the composite, or including an acid releasing light sensitive material in the sheet and irradiating the material (where it is sensitive to a different portion of the spectrum than the dye-borate system). The useful acids include for example, carboxylic acids (e.g., acetic acid, stearic acid, salicylic acid, etc.), inorganic acids (e.g., nitric acid, sulfuric acid, hydrobromic acid, hydrochloric acid, sulfamic acid), and organic acids other carboxylic acids (e.g., aliphatic sulfonic and sulfonylic acids, fluorinated or perfluorinated carboxylic acids, etc.). Other materials which may be applied to the sheet in similar fashions include aldehydes (particularly by vapor treatment), peroxides, iodine, readily reducible metal ions, and quinones. Latent oxidants such as bisimidazoles could be used also. These materials need only be introduced into reactive association with the tetra(hydrocarbyl)borane to effect fixing. Reactive association is defined as such physical proximity between materials as to enable a chemical reaction to take place between them.

In other imaging systems, like those described in the prior art for aromatic tetra(hydrocarbyl)borates, the tetra(aliphatic)borates of the present invention may be used as a replacement for the aromatic borates.

A variety of conventional additives such as surfactants, antioxidants (e.g., phenidone), ultraviolet radiation absorbers, coating aids, fillers (e.g., glass beads, glass fibers, etc.) may be added to the compositions to obtain the benefit of their known properties. These compositions may be applied to any substrate such as clear polymeric film, paper, pigmented film, metal film or metallized film, etc.

These and other aspects of the present invention may be seen in the following examples.

EXAMPLES 1-5

These examples are intended to show the relative dye bleaching speed of dye compositions with tetra(aliphatic)borates in comparison to compositions with aromatic and mixed aliphatic and aromatic tetrahydrocarbyl borates. In all examples, 100 mg of cationic Indolenine Red (Color Index 48070) was coated out in 10 ml. of a 15% by weight solution of polyvinyl acetate in methylethylketone (MEK) and toluene (50/50). In Example 1, the anion was tetrabutyl borate, and in Examples 2-5, the anion was 4-perfluoroethylperfluorocyclohexane sulfonate (hereinafter PECHS). The sheets were dried at 65° C. and then exposed through a 0-2 optical density wedge. The exposure times used on each sample were those exposures necessary to reach the minimum optical density ($D_{min}$) for the system. Two speed points on the resulting density (D) versus log of the exposure (logE) curves were selected for comparison. The first speed point was where the optical density (O.D.) had dropped 0.8 units. The second speed point was where the optical density was 1.0 units above the $D_{min}$. The relative exposure times used to generate D (density) vs LogE (energy of exposure) curves are given. The fastest time was used as the reference point for the relative values. The results are shown in Table I. Example 5 used the sodium salt rather than the tetraethylammonium salt because of problems with the solubility of the latter salt.

TABLE I

| Ex. | Photoactive Agent | Exposure Time (sec.) | $D_{max}-0.8$ | $D_{min}+1.0$ |
|---|---|---|---|---|
| 1 | Indolenine Red$^+$B Bu$_4^-$ +Et$_4$N$^+$B Bu$_4^-$ | 5 | 1.0 | 1.0 |
| 2 | Et$_4$N$^+$B Bu$_4^-$ | 15 | 2.27 | 2.46 |
| 3 | Et$_4$N$^+$B Bu$_3$(C$_6$H$_5$)$^-$ | 45 | 11.29 | 11.51 |
| 4 | Et$_4$N$^+$B Bu(C$_6$H$_5$)$_3^-$ | 225 | 35.42 | 36.39 |
| 5. | Na$^+$ B(C$_6$H$_5$)$_4^-$ | 1500 | 976.5 | — |

As can be seen from this data the fastest system comprised the tetra(aliphatic)borate as both the dye anion and light sensitive agent. The tetra(aliphatic) borate alone was approximately five times faster than the tri(aliphatic)monoaromaticborate, approximately fifteen times faster than the tri(aromatic)monoaliphaticborate, approximately four hundred times faster than the tetra(aromatic)borate. The $D_{min}$ +1.0 reading on Example 5 was not taken because the $D_{min}$ was not reached even after 25 minutes exposure.

The significant speed increase using the tetra(aliphatic)borates can readily be seen from these examples.

EXAMPLES 6-7

10 mg of Indolenine Red chloride was coated out in a polyvinyl alcohol binder (5 g of a 7.5% by weight in aqueous solution) with a slight molar excess of sodium tetraethyl borate onto a polyester film backing. This was done under safelight conditions. When the resulting film was inserted into the slide compartment of a commercial slide projector and irradiated, complete bleaching was achieved in less than one second.

The same experiment was repeated except that sodium tetraphenyl borate was used. An irradiation of over one minute gave only partial bleaching.

A sample of the tetraethylborate film was treated with an aqueous solution of acetic acid, and when irradiated in a slide projector, little or no bleaching was effected. This shows that the system can be fixed.

Another sample of the tetraethylborate film was exposed through a photothermographic, dry silver fiche element using standard xenon flash lamps. An excellent magenta duplication of the fiche resulted. This duplicate was then fixed by exposing it to hydrochloric acid vapor. Upon subsequent exposure to light, no further bleaching was noticeable. The comparative gray scale (or tonal reproduction) and resolution of the duplicate were excellent.

EXAMPLE 8

Samples of the dye tris(2-methyl-4-diethylaminophenyl)carbenium perfluoro(4-ethylcyclohexane) sulfonate (PECHS) were solution coated at saturated concentrations in a polyvinylacetate binder. The solvent used was a 3:1 (weight) solution of methylethylketone and toluene (Tol.). A slight molecular excess of sodium tetraethylborate was incorporated into the solution. The resulting solution was knife coated at 3 mils ($7.62\times10^{-3}$ cm) wet thickness on polyester and air dried in the dark. The dried coating was stored in the dark and subsequently subjected to varying amounts of focused laser light of wavelength 6328 Å for several periods of time. Light power density was varied using neutral density filters. Exposure time was controlled by a mechanical shutter with electronic activation. The focused spot size was held constant and the recorded spot size was found to be a function of optical power density and exposure time. The dye-borate-binder system was then fixed using the following methods: acid vapor exposure (acetic acid for two minutes) or, acid treated paper contact and heat (30 seconds, salicylic acid, 95° C.). Samples were examined microscopically to determine spot size and photomicrographs were taken.

The laser power density was $2.037\times10^{2}$ watts/cm$^2$. Neutral density filters 1.0, 2.0, 3.0 and 4.0 were employed to reduce power. Exposure times used were $2/2^n$ where n=0, 1, 2, . . . 8. The following data were obtained:

TABLE II

| N.D. Filter | Exposure (sec) | Spot Diameter (μm) | Energy Density (nJ/m$^2$) |
|---|---|---|---|
| 2.0 | 0.0625 | 15.0 | 1.171 |
| 3.0 | 2.00 | 25.0 | 3.869 |
| 3.0 | 1.00 | 19.0 | 1.924 |

EXAMPLES 9–13

Indolenine Red-PECHS (50 mg) and tetraethylammonium tetravinylborate (100 mg) were treated with 1 ml of methanol. To this mixture was added 4 ml of polyvinylacetate solution (10% solids in MEK:Tol, 3:1). The resulting solution was coated (at $7.6\times10^{-3}$ cm wet thickness) onto polyester and air dried in the dark. The film was imaged through a black and white transparency on an overhead projector using an exposure of 5 minutes. The imaged film was fixed by exposure to HCl vapors for 2 minutes and provided a stable image.

The films in Table III were prepared, imaged and fixed in a similar fashion with essentially similar results. The nomenclature for the compounds, e.g., $Et_4NBBu_3CN$, shows the cation first (e.g., $Et_4N$) and then the anion (e.g., $BBu_3CN$).

TABLE III

| Bleach Agent/Amount | Exposure |
|---|---|
| $Et_4NBBu_3CN$/100 mg | 30 min. |
| $Et_4NB(C\ CCH_3)_4$/100 mg | 30 min |
| $Et_4NBBu_3(CH{=}CH_2)$/100 mg | 30 sec. |
| $Et_4NBBu_3(CH_2{-}C_6H_5)$/100 mg | 30 sec. |

EXAMPLE 14

A solution of Indolenine Red-PECHS (50 mg), tetraethylammonium(phenylethynyl)tributylborate (100 mg), and polyvinylacetate solution (5 ml of a 10% solids solution in MEK:Tol, 3:1) was coated onto polyester ($7.6\times10^{-3}$ cm wet thickness) and the film set aside to dry in the dark. A sample of the film was imaged through a black and white transparency on an overhead projector. The imaged film was placed in a chamber with HCl vapor to fix the image.

Step tablet exposures indicated that the $Et_4NBBu_3(C{\equiv}CPh)$ films were approximately 5–8 times slower than comparable $Et_4NBBu_4$ films.

EXAMPLE 15

A solution of Indolenine Red-PECHS (50 mg), tetraethylammonium tetramethylborate (100 mg), and polyvinylacetate (5 ml of a 10% solids solution in MEK:Tol, 3:1) was coated onto polyester ($7.6\times10^{-3}$ cm wet thickness) and the film was set aside to dry in the dark. A sample of the film was imaged through a black and white transparency on an overhead projector. The imaged film was fixed by exposure to HCl vapor for 2 minutes.

Step tablet exposures indicated that $Et_4NBMe_4$/Indolenine Red-PECHS films were 4–6 times slower than comparable $Et_4NBBu_4$ films.

EXAMPLE 16

General Procedure

Binder solutions were prepared as 10 percent (by weight) solids in 3:1 (volume:volume) solutions of methylethylketone:toluene. The indicated amounts of dye and bleach agent were dissolved in 1 ml of the corresponding binder solution (see chart), and coated ($7.62\times10^{-3}$ cm wet thickness) on 2 mil ($5.08\times10^{-3}$ cm) polyester. The films were air dried.

The films were imaged with an overhead projector. Stable (to light) images were produced by fixing with acetic acid vapor or by dipping into a solution of trifluoroacetic acid in perfluorotributylamine (½ percent by weight).

The following dyes were used in this example.

Dye 1
a thiazole carbocyanine

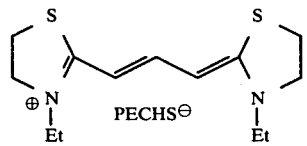

(yellow)

Dye 2
an anilino dicarbocyanine

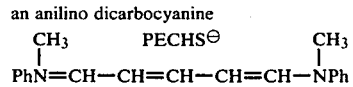

(yellow)

-continued

Dye 3 an azomethine

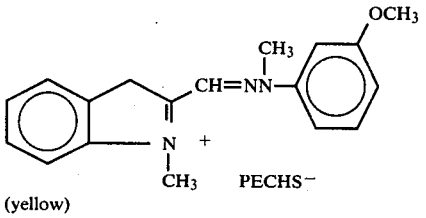

(yellow)

Dye 4 a benzoxazole carbocyanine

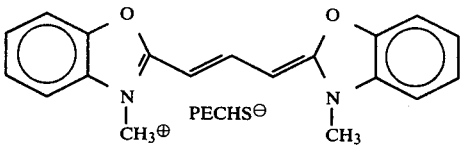

(yellow)

Dye 5 a styryl

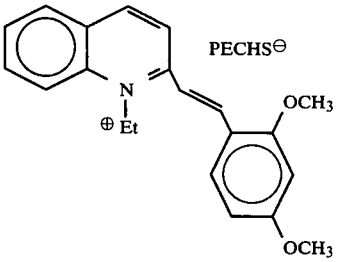

(yellow)

Dye 6 an azine

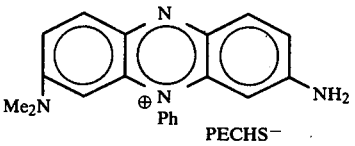

(basic violet 5)

Dye 7 a xanthine

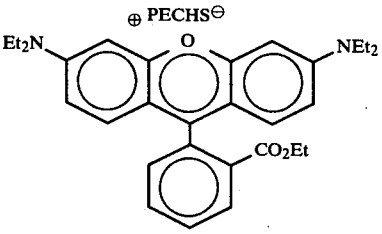

(basic violet 11)
(rhodamine 3B)

Dye 8 a styryl

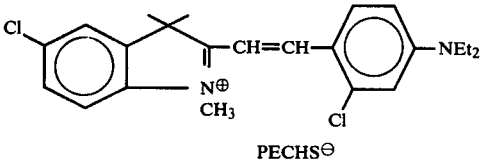

(a magenta)

-continued

Dye 9 a butadienyl

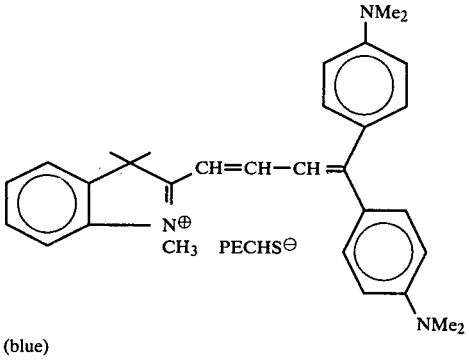

(blue)

Dye 10 a trinuclear carbocyanine

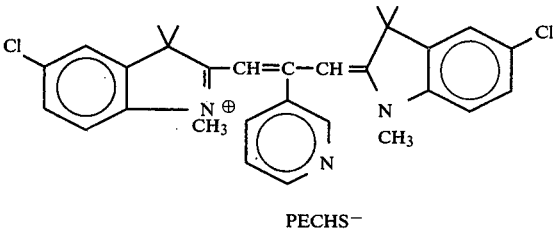

(a blue dye)

Bleach Agent

A = $Et_4NBBu_4$
B = $Et_4BBu_3C{\equiv}CCH_3$
C = $Et_4NBEt_4$

| Dye | Bleach Agent | Binder | Fix Method |
|---|---|---|---|
| 1 (5mg) | A (20mg) | H.M.W. PMA | Acetic Acid Vapors |
| 2 (10mg) | A (25mg) | Elvacite ®2041 | TFA Solution |
| 3 (10mg) | A (25mg) | Elvacite ®2041 | TFA Solution |
| 4 (25mg) | C (25mg) | H.M.W. PMA | Acetic Acid Vapors |
| 5 (10mg) | A (25mg) | Elvacite ®2041 | TFA Solution |
| 6 (10mg) | C (25mg) | H.M.W. PMA | Acetic Acid Vapors |
| 7 (18mg) | C (25mg) | H.M.W. PMA | Acetic Acid Vapors |
| 8 (10mg) | C (30mg) | H.M.W. PMA | Acetic Acid Vapors |
| 9 (13mg) | B (30mg) | PVAc | TFA Solution |
| 10 (10mg) | B (25mg) | PVAc | TFA Solution |

PVAc = poly(vinyl acetate)
H.M.W. PMA = "high" molecular weight poly(methylacrylate)
Elvacite ®2041 = a "high" molecular weight poly(methylmethacrylate) (hereafter PMMA)
TFA = trifluoroacetic acid in an inert fluorinated amine solvent

EXAMPLES 17–78

These examples are provided to illustrate the general utility of the present invention with any dye, including dyes from the classes of methines, cyanines, triarylmethanes, carbocyanines, azomethines, azines, styryls, xanthines, ketomethylenes, phenolics, naphtholics, indines, quinolines, oxazines, thiazines, diazines, acridine, etc.

In these examples, Ar means:

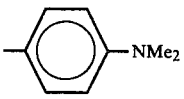

The procedure for exposing and developing were the same as in Example 16. About 10–20 mg dye (sufficient to reach an optical density of at least 1.0 at the indicated film thickness) and 20–30 mg of the light sensitive borate bleach agent were used. The coating thickness (wet) was $7.6\times10^{-3}$ cm on polyethyleneterephthalate base. All systems provided images and were capable of being fixed. The dyes, bleaching borates, fixers, and binders are shown below.

EXAMPLES

| Ex. No. | Dye | Bleach | Fix | Binder |
|---|---|---|---|---|
| 17 | 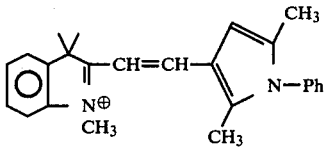 PECHS | $BBEt_4^{\ominus}$ | HOAc vapor | PMA |
| 18 | 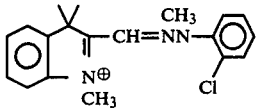 $PECHS^{\ominus}$ | $BBu_4^{\ominus}$ | TFA | PMMA |
| 19 | 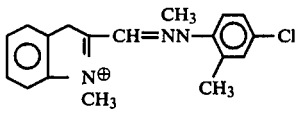 $PECHS^{\ominus}$ | $BBu_4^{\ominus}$ | TFA | PMMA |
| 20 | 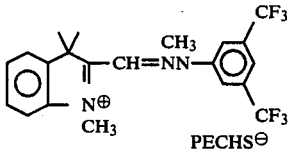 $PECHS^{\ominus}$ | $BBu_4^{\ominus}$ | TFA | PMMA |
| 21 | 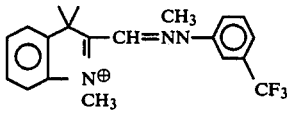 | $BBu_4^{\ominus}$ | TFA | PMMA |
| 22 | 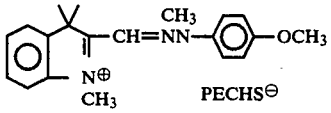 $PECHS^{\ominus}$ | $BBu_4^{\ominus}$ | Acetic Acid Vapor | PMA |
| 23 | 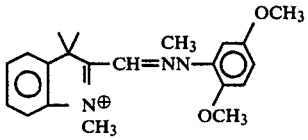 | $BBu_4^{\ominus}$ | TFA | PMMA |
| 24 | 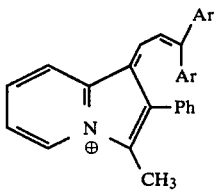 $PECHS^{\ominus}$ | $BBu_3C{\equiv}C\overset{\ominus}{C}H_3$ | TFA | PVAc. |
| 25 | 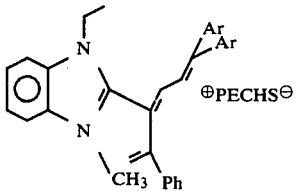 | $BBu_3C{\equiv}CCH_3$ | TFA | PVAc. |

EXAMPLES-continued

| Ex. No. | Dye | Bleach | Fix | Binder |
|---|---|---|---|---|
| 26 | 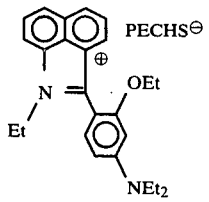 | $BBu_4^{\ominus}$ | TFA | PVAc. |
| 27 | 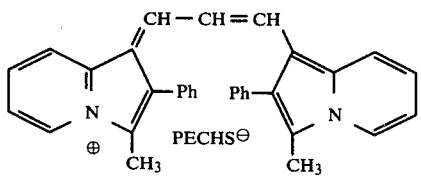 | $BBu_3C{\equiv}C\overset{\ominus}{C}H_3$ | TFA | PVAc. |
| 28 | 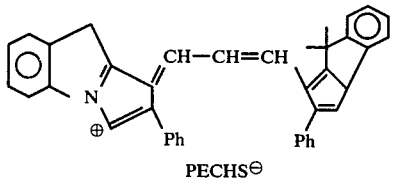 | $BBu_3C{\equiv}C\overset{\ominus}{C}H_3$ | TFA | PVAc. |
| 29 | 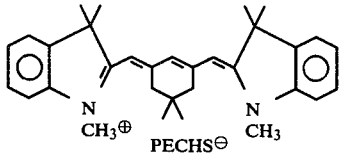 | $BBu_3C{\equiv}C\overset{\ominus}{C}H_3$ | TFA | PVac. |
| 30 | 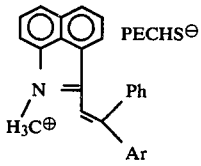 | $BBu_3C{\equiv}C\overset{\ominus}{C}H_3$ | TFA | PVAc. |
| 31 | 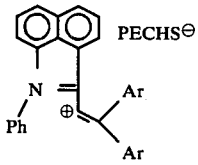 | $BBu_3C{\equiv}C\overset{\ominus}{C}CH_3$ | TFA | PVAc. |
| 32 | 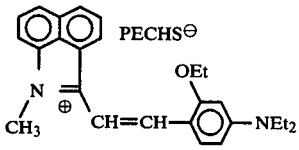 | $BBu_3C{\equiv}C\overset{\ominus}{C}H_3$ | TFA | PVAc. |
| 33 | 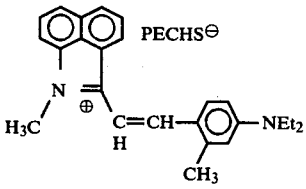 | $BBu_3C{\equiv}C\overset{\ominus}{C}H_3$ | TFA | PVAc. |
| 34 | 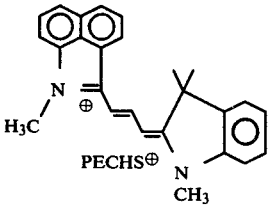 | $BBu_3C{\equiv}\overset{\ominus}{C}Ph$ | TFA | PVAc. |

EXAMPLES-continued

| Ex. No. | Dye | Bleach | Fix | Binder |
|---|---|---|---|---|
| 35 | 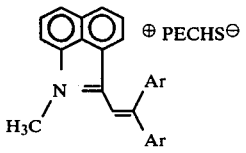 | $BBu_3C{\equiv}C\overset{\ominus}{C}H_3$ | TFA | PVAc. |
| 36 | 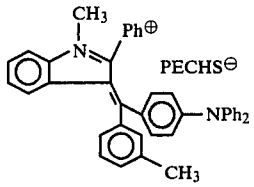 | $B^{\ominus}Bu_3C{\equiv}CCH_3$ | TFA | PVAc. |
| 37 | 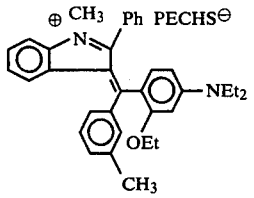 | $B^{\ominus}Bu_3C{\equiv}CCH_3$ | TFA | PVAc. |
| 38 | 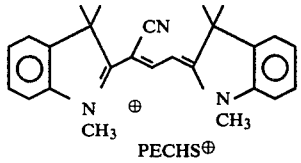 | $BBu_4^{\ominus}$ | TFA | PVAc. |
| 39 | 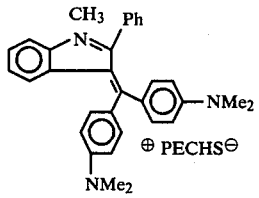 | $BBu_4^{\oplus}$ | TFA | PVAc. |
| 40 | 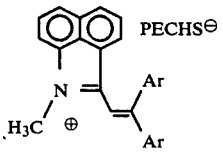 | $BBu_3C{\equiv}C\overset{\ominus}{C}H_3$ | TFA | PVAc. |
| 41 | 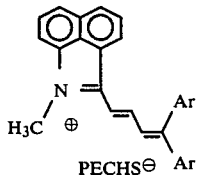 | $BBu_3C{\equiv}C\overset{\ominus}{C}Ph$ | TFA | PVAc |
| 42 | Basic Blue 47<br>Sumiacryl Blue 3R<br>(as PECHS salt) | $BBu_4^{\ominus}$ | TFA | PVAc. |
| 43 | Basic Blue 56<br>Sumiacryl Blue 3R<br>(as PECHS salt) | $BBu_4^{\ominus}$ | TFA | PVAc. |
| 44 | 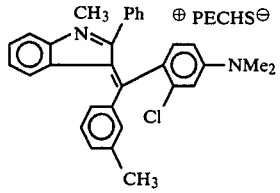 | $BBu_3C{\equiv}C\overset{\ominus}{C}H_3$ | TFA | PVAc. |

EXAMPLES-continued

| Ex. No. | Dye | Bleach | Fix | Binder |
|---|---|---|---|---|
| 45 | 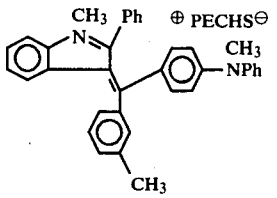 | $BBu_3C{\equiv}C\overset{\ominus}{C}H_3$ | TFA | PVAc. |
| 46 | 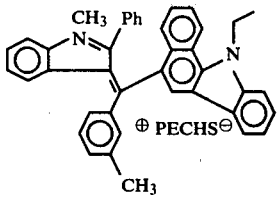 | $B^{\ominus}Bu_3C{\equiv}C\overset{\ominus}{C}H_3$ | TFA | PVAc. |
| 47 | 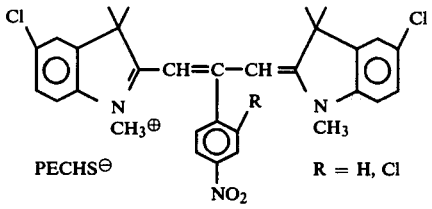 | $B^{\ominus}Bu_3C{\equiv}CCH_3$ | TFA | PVAc. |
| 48 | 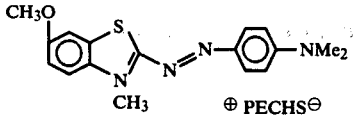 | $BBu_3C{\equiv}C\overset{\ominus}{C}H_3$ | TFA | PVAc. |
| 49 | 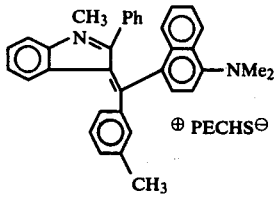 | $BBu_3C{\equiv}C\overset{\ominus}{C}H_3$ | TFA | PVAc. |
| 50 | 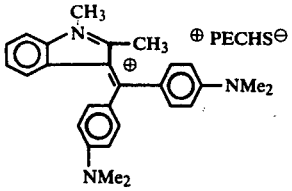 | $BBu_4^{\ominus}$ | TFA | PVAc. |
| 51 | 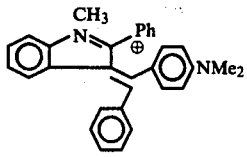 | $BBu_3C{\equiv}C\overset{\ominus}{C}H_3$ | TFA | PVAc. |
| 52 | 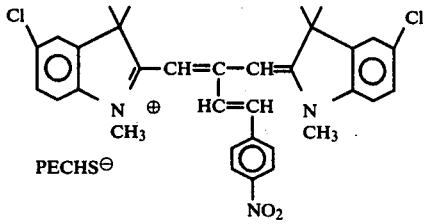 | $BBu_3C{\equiv}C\overset{\ominus}{C}H_3$ | TFA | PMMA |

EXAMPLES-continued

| Ex. No. | Dye | Bleach | Fix | Binder |
|---|---|---|---|---|
| 53 | 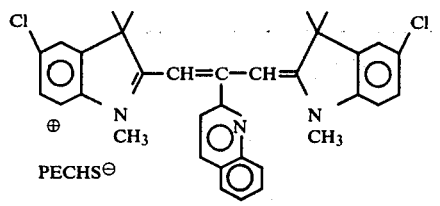 | $BBu_3C{\equiv}C\overset{\ominus}{C}H_3$ | TFA | PMMA |
| 54 | 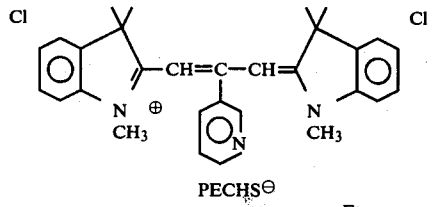 | $BBu_3C{\equiv}C\overset{\ominus}{C}H_3$ | TFA | PMMA |
| 55 | 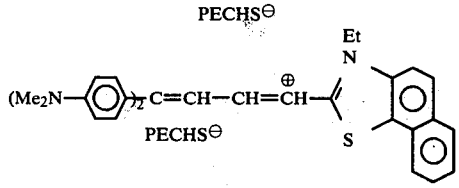 | $BEt_4^{\ominus}$ | TFA | Polyvinyl Formal |
| 56 | 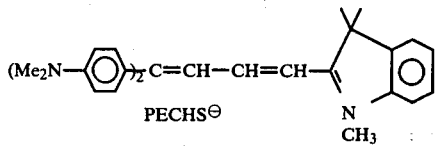 | $BEt_4^{\ominus}$ | TFA | Polyvinyl Formal |
| 57 | 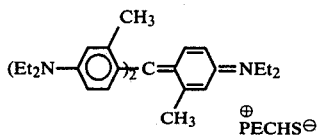 | $BEt_4^{\ominus}$ | HOAc vapor | Polyvinyl Formal |
| 58 | 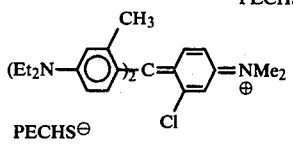 | $BEt_4^{\ominus}$ | HOAc vapor | Polyvinyl Formal |
| 59 | 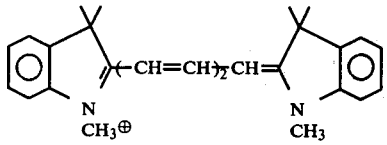 | $BBu_3C{\equiv}CCH_3$ | TFA | PVAc. |
| 60 | 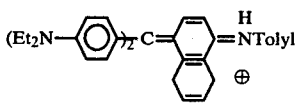 | $BBu_4^{\ominus}$ | Salicyclic Acid | PMA |
| 61 | 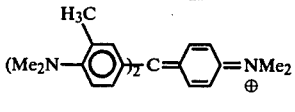 | $BBu_4^{\ominus}$ | HOAc vapor | PMA |
| 62 | 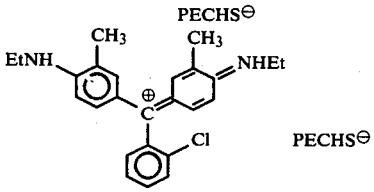 | $BEt_4^{\ominus}$ | HOAc | PMA |
| 63 | 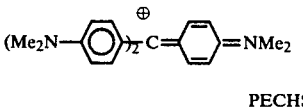 | $B^{\ominus}Bu_3C{\equiv}CPh$ | Salicylic Acid | PMMA |

EXAMPLES-continued

| Ex. No. | Dye | Bleach | Fix | Binder |
|---|---|---|---|---|
| 64 | 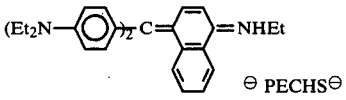 | $BEt_4^{\ominus}$ | HOAc. vapor | PMA |
| 65 | 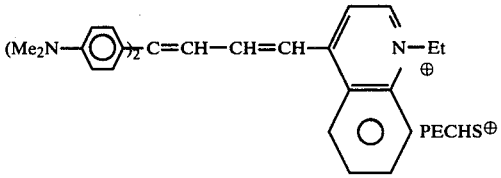 | $B^{\ominus}Bu_3C{\equiv}CPh$ | TFA | Polyvinyl Formal |
| 66 | 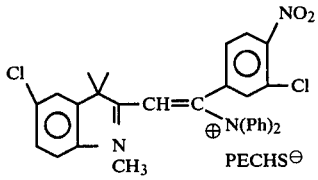 | $BBu_4^{\ominus}$ | TFA | PMMA |
| 67 | 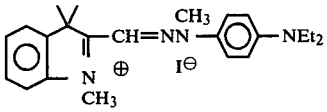 | $BBu_4^{\ominus}$ | HOAc. vapor | PMA |
| 68 | 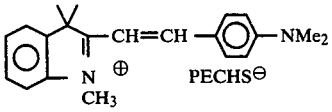 | $BBu_4^{\ominus}$ | HOAc. vapor | Polyvinyl Formal |
| 69 | 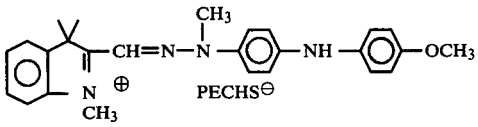 | $BBu_4^{\ominus}$ | HOAc. vapor | PMA |
| 70 | 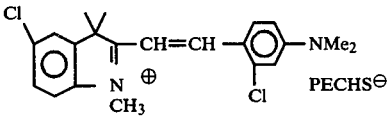 | $BEt_4^{\ominus}$ | HOAc. vapor | PMA |
| 71 | 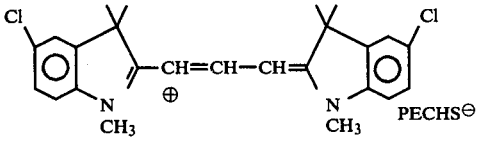 | $BBu_4^{\ominus}$ | TFA | PMMA |
| 72 | 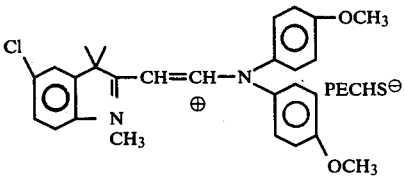 | $BBu_4^{\ominus}$ | TFA | PMMA |
| 73 | 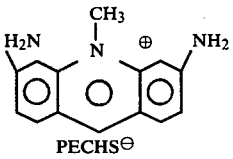 | $BBu_4^{\ominus}$ | TFA | PMMA |
| 74 | 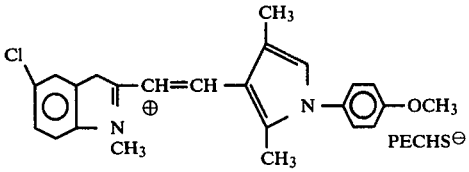 | $BBu_4^{\ominus}$ | TFA | PMMA |

EXAMPLES-continued

| Ex. No. | Dye | Bleach | Fix | Binder |
|---|---|---|---|---|
| 75 | 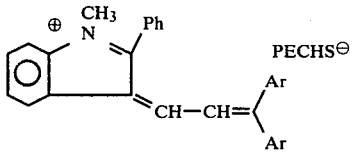 | $BBu_3C{\equiv}\overset{\ominus}{C}CH_3$ | TFA | PVAc. |
| 76 | 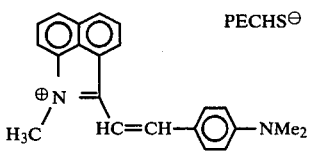 | $BBu_3C{\equiv}\overset{\ominus}{C}CH_3$ | TFA | PVAc. |
| 77 | 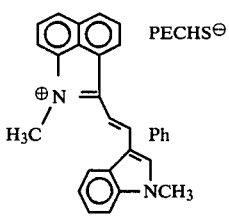 | $BBu_3C{\equiv}\overset{\ominus}{C}CH_3$ | TFA | PVAc. |
| 78 | 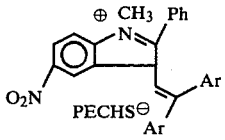 | $BBu_3C{\equiv}\overset{\ominus}{C}CH_3$ | TFA | PVAc. |

EXAMPLE 79

A three color film element was constructed by coating one side of a $1.06\times10^{-2}$ cm clear polyester film with a $7.6\times10^{-3}$ cm wet thickness cyan layer and coating the other side of the polyester film with a mixed red and yellow layer of the same wet thickness. The layers were air dried in the dark. The composition of the respective layers was as follows:

| | | |
|---|---|---|
| Cyan Layer | - | 5 ml polyvinylacetate (10% solids in methylethylketone and toluene, 3:1 by weight), 30 mg Indolenine Blue PECHS, and 30 mg tetraethyl ammonium tributylethynylphenylborate |
| Red and Yellow Layer | - | 5 ml of the same polyvinylacetate as in the cyan layer, 45 mg Indolenine Red PECHS, 25 mg Indolenine Yellow PECHS, and 70 mg of tetraethyl ammonium tetrabutyl borate. |

The dye structures were:

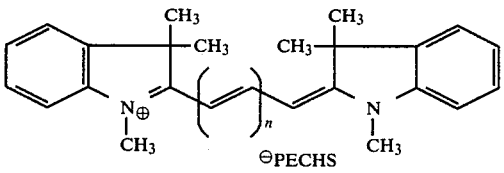

wherein

Indolenine Yellow is n=0,

Indolenine Red is n=1, and

Indolenine Blue (also known as Malonal Cyan) is n=2.

The multicolor film element was placed in contact with a full color transparency. A twenty-five second light exposure was made from a 3M Model 261 Microfiche Printer (having a T-8 diazo lamp) through the transparency. A full color reproduction of the original was obtained. The imaged sample was then rendered insensitive to further light exposure by subjecting the sample to HCl vapors in a dessicator for 3 minutes.

What we claim is:

1. A radiation sensitive element comprising a substrate having coated on at least one side thereof a layer comprising a radiation sensitive tetra(aliphatic) borate salt, said element is for imaging.

2. The radiation sensitive element of claim 1 wherein said borate has the formula

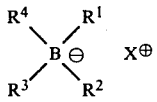

wherein $R^1$, $R^2$, $R^3$, and $R^4$ are independently aliphatic groups bonded to the boron from a carbon atoms, and $X^+$ is any cation except those that break at least one carbon to boron bond on the borate.

3. The radiation sensitive element of claim 2 wherein said cation is an organic cation.

4. The radiation sensitive element of claim 3 wherein a dye is in reactive association with said borate salt.

5. The radiation sensitive element of claim 4 wherein said dye is a cationic dye.

6. The radiation sensitive element of claims 4 or 5 wherein said borate and dye are in a binder layer.

7. The radiation sensitive element of claim 6 wherein said binder layer comprises an organic polymeric binder.

8. The radiation sensitive element of claim 3 wherein said cation is a quaternary ammonium cation.

9. The radiation sensitive element of claim 7 wherein said borate is a tetra(alkyl) borate with the alkyl groups independently having from 1 to 20 carbon atoms.

10. The radiation sensitive element of claim 9 wherein said alkyl groups have from 1 to 8 carbon atoms.

11. The radiation sensitive element of claim 10 wherein said alkyl groups are each ethyl or butyl.

12. The radiation sensitive element of claims 4, 5, or 6 wherein $R^1$, $R^2$, $R^3$, and $R^4$ are selected from allyl and alkyl groups having from 1 to 20 carbon atoms.

13. The radiation sensitive element of claim 12 wherein $R^1$, $R^2$, $R^3$ and $R^4$ are alkyl having from 1 to 20 carbon atoms.

14. The radiation sensitive element of claim 6 wherein said binder is selected from the class consisting of polycarbonates, polystyrenes, polystyrene/acrylonitriles, polyvinyl acetate, polyacrylates, polymethacrylates, and polyvinyl acetals.

15. The radiation sensitive element of claims 4, 6, 9, 10, 13 or 14 wherein said dye is selected from the class consisting of methines, cyanines, carbocyanines, azomethines, styryls, xanthenes, or azines.

16. The element of claim 4 wherein said dye is photobleachable because of its reactive association with said borate salt.

* * * * *

UNITED STATES PATENT AND TRADEMARK OFFICE

CERTIFICATE OF CORRECTION

PATENT NO. : 4,307,182

DATED : December 22, 1981

INVENTOR(S) : Dalzell et al.

It is certified that error appears in the above—identified patent and that said Letters Patent is hereby corrected as shown below:

Column 13-14, Example 29, delete "PVac." and insert --PVAc.-- in its place.

Column 15-16, Example 41, delete "$^{\ominus}$CCPh" and insert --$^{\ominus}$CPh--.

Column 17, Example 51, --PECHS$^{\ominus}$-- should be inserted next to "$^{\oplus}$".

Column 19, Example 60, --PECHS$^{\ominus}$-- should be inserted below 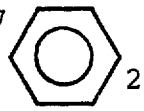 .

Column 21, Example 64, delete "$^{\ominus}$PECHS$^{\ominus}$" and insert --$^{\oplus}$PECHS$^{\ominus}$-- in its place.

Column 21, Example 65, delete "PECHS$^{\oplus}$" and insert --PECHS$^{\ominus}$-- in its place.

Signed and Sealed this

Nineteenth Day of October 1982

[SEAL]

Attest:

GERALD J. MOSSINGHOFF

Attesting Officer

Commissioner of Patents and Trademarks